US008800667B2

(12) United States Patent
Seim

(10) Patent No.: US 8,800,667 B2
(45) Date of Patent: Aug. 12, 2014

(54) ARRANGEMENT FOR DIRECTING A FLUID FLOW

(75) Inventor: Lars Seim, Espeland (NO)

(73) Assignee: Framo Engineering AS, Bergen (NO)

( * ) Notice: Subject to any disclaimer, the term of this patent is extended or adjusted under 35 U.S.C. 154(b) by 680 days.

(21) Appl. No.: 12/993,788

(22) PCT Filed: May 18, 2009

(86) PCT No.: PCT/NO2009/000189

§ 371 (c)(1),
(2), (4) Date: May 11, 2011

(87) PCT Pub. No.: WO2009/142507

PCT Pub. Date: Nov. 26, 2009

(65) Prior Publication Data

US 2011/0203806 A1 Aug. 25, 2011

(30) Foreign Application Priority Data

May 20, 2008 (NO) ..... 20082295

(51) Int. Cl.
*E21B 34/04* (2006.01)

(52) U.S. Cl.
USPC ..... 166/373; 166/330; 166/65.1; 166/313

(58) Field of Classification Search
USPC ..... 166/373, 330, 65.1, 50, 313, 53, 66.6
See application file for complete search history.

(56) References Cited

U.S. PATENT DOCUMENTS

| | | | | |
|---|---|---|---|---|
| 2,996,083 | A | 8/1961 | Huska | |
| 4,378,848 | A | 4/1983 | Milberger | |
| 4,968,334 | A | 11/1990 | Hilton | |
| 5,109,713 | A | 5/1992 | Romero et al. | |
| 5,413,143 | A | 5/1995 | D'Agostino et al. | |
| 5,520,216 | A | 5/1996 | D'Agostino et al. | |
| 6,000,430 | A | 12/1999 | Nafz | |
| 6,397,948 | B1 | 6/2002 | Williams et al. | |
| 6,464,011 | B2 * | 10/2002 | Tubel | 166/313 |
| 2006/0118308 | A1 | 6/2006 | Saucier | |
| 2008/0093081 | A1 | 4/2008 | Stoisits et al. | |

FOREIGN PATENT DOCUMENTS

| | | | |
|---|---|---|---|
| NO | 322524 | B1 | 10/2006 |
| WO | WO 2005/108833 | A1 | 11/2005 |
| WO | WO 2006/104393 | A1 | 10/2006 |

* cited by examiner

*Primary Examiner* — Yong-Suk (Philip) Ro
(74) *Attorney, Agent, or Firm* — Merchant & Gould P.C.

(57) ABSTRACT

An arrangement for directing a fluid flow or a tool transported in a fluid flow in an under water structure includes plural flow line arrangements each including at least one flow line, and at least two distribution devices to be varied between at least two positions. One distribution device connects at least two flow arrangements providing for the selection of the fluid flow pattern directing the fluid through the distribution devices and the flow arrangements depending on the position of each of the distribution devices. A method directs a fluid flow or a tool transported in a fluid flow.

13 Claims, 4 Drawing Sheets

ARRANGEMENT FOR DIRECTING A FLUID FLOW

This application is a National Stage Application of PCT/NO2009/000189, filed 18 May 2009, which claims benefit of Serial No. 20082295, filed 20 May 2008 in Norway and which applications are incorporated herein by reference. To the extent appropriate, a claim of priority is made to each of the above disclosed applications.

BACKGROUND OF THE INVENTION

The invention concerns an arrangement and a method for directing a fluid flow or a tool transported by a fluid flow in an under water structure.

Various apparatuses and method for distribution of fluid are known in the art.

The following publications show apparatuses for distribution of fluid;

NO 322524 discloses a manifold for connecting or dividing one of several flows of fluid. The manifold comprises a housing with a diverter system rotatably arranged in the housing.

U.S. Pat. No. 6,000,430 shows a distribution valve with plural inlets for receiving inflows and outlets for an outflow mixture of fluids. Further the distribution valve has a rotatable distributing element having a mixing chamber in communication with the openings.

The above mentioned publications show apparatuses for distribution of fluid and do not concern an arrangement to direct fluid in flow lines as is the object of the present invention.

SUMMARY OF THE INVENTION

The object of the invention is obtained by an arrangement and a method as defined in the independent claims. Further embodiments of the invention are defined in the following dependent claims.

The invention concerns an arrangement for directing a fluid flow or a tool transported in a fluid flow in an under water structure. The tool may be transported by the pressure generated by the fluid flow or by its own driving means. The arrangement comprises plural flow line arrangements each including at least one flow line, and at least two distribution devices to be varied between at least two positions. One distribution device connects at least two flow lines providing for the selection of the fluid flow pattern directing the fluid through the distribution devices and the flow lines depending on the position of each of the distribution devices. The arrangement may be prepared for the fluid to flow in a loop shaped pattern.

The distribution device to determine the flow through the under water structure may be arranged with suitable components capable of providing various flow pattern by interconnecting the flow lines included in the arrangement. In one aspect of the invention the distribution device comprises a housing arranged with plural ports for inlet and outlet of a fluid flow. A selector body is arranged in the housing being movable between various positions and provided for interconnecting at least two flow lines. The selector body may be provided so as to position a through passage of the selector body in line with two of the ports for communication of fluid flow from one flow line through the distribution device and into another flow line. Further the housing may be provided with an access port to be used for maintenance or in case of emergency.

The claimed invention may find various fields of use. The arrangement according to the invention may be usable for the inspection, monitoring, servicing and maintenance of an under water structure comprising fluid flow lines which may be connected to subsea wells. These activities may be carried out by a fluid such as service fluid flowing in the flow lines or by a tool such as a pig having propulsion or being transported in the flow line by a fluid flow. In the cases where the flow lines of the inventive arrangement is in fluid communication with a sub sea structure such as a well or equipment included in a well, the inventive arrangement may also be usable for the transport of hydro carbon during the production period.

The flow line arrangements may comprise just a flow line having one end connected to a distribution device and the other end connected to another distribution device. Alternatively, one of the flow line arrangements may comprise plural flow lines and at least one distribution device, but possibly also plural distribution devices. Depending on the field of use this kind of flow line arrangement may include two flow lines and one distribution device or plural distribution device and plural flow lines. The arrangement in accordance with the invention may be made up by various flow line arrangements as the one mentioned above or by one single kind of flow line arrangements.

In one embodiment the arrangement according to the invention comprises a first flow line arrangement with a first distribution device and a second distribution device provided at each end of the first flow line arrangement. The arrangement is further provided with at least an additional flow line arrangement having one end connected to the first distribution device and the other end connected to the second distribution device. The additional flow line arrangement may comprise a single flow line or plural flow lines interconnected by at least one distribution device. The number of additional flow line arrangements to be included in this arrangement may be varied according the field of use. One or plural of the additional flow line arrangements may be provided for the fluid to flow in a loop.

The arrangement may be provided by a first and a second additional flow line arrangement, each having one end connected to the first distribution device and the other end connected to the second distribution device. The selected position of the first and second distribution devices is used for determining the various flow patterns. Depending on the position of the distribution devices, the first additional flow line arrangement may be connected to the first flow line arrangement or the second additional flow line arrangement may be connected to the first flow line arrangement. Alternatively, the distribution device may be placed in a position connecting first and second additional flow line arrangement. In these three different ways of providing connection between the flow line arrangements, the arrangement is prepared for looped circulation patterns to take place.

In one embodiment a main flow line may be provided with at least two main distribution devices and a number of loops wherein each loop comprises a flow line or configuration of a number of flow lines and distribution devices, with one end of each loop being connected to one the main distribution devices and the other end of each loop to another of the main distribution devices. The fluid flow is to be directed in a selected looped flow pattern depending on the position of each of the main distribution devices and distribution devices.

The arrangement according to the invention, may be provided with at least one additional flow line extending from a surface or subsurface vessel and being connected to one of the distribution devices. The vessel is of a kind well known within the offshore field such as a FPSO, a semi submersible platform, a floating platform or any other kind suitable for carrying out under water activities related to the production of hydrocarbons, and service and maintenance of submerged flowlines.

The additional flow line may be a riser or a riser connected to a flow line or flow line arrangement connected to a distribution device. The additional flow line communicates fluid or a tool to or from the under water structure. The arrangement in accordance with the invention may in one embodiment, wherein the hydrocarbons is to be transported through the under water structure, be provided with means for communication with an under water structure such as a well or an subsea structure. In this embodiment at least one of the distribution devices or a valve is arranged for communication of fluid between the flow line arrangements and the well.

The invention also include a method for directing a fluid flow or a tool transported in a fluid flow in an under water structure wherein the tool may be a pig as mentioned above. The fluid flows in fluid line arrangement comprising a main flow line which is provided with at least two main distribution devices to be varied between at least two positions. The fluid line arrangement comprises at least two loops wherein each loop comprises a configuration of a number of flow lines and distribution devices. Each loop is arranged with one end connected to the main distribution device and the other end of each loop to another of the main distribution devices. Selecting a position of a main distribution device directs the fluid to flow in a certain flow pattern in the selected loop. Selecting another position of a main distribution device directs the fluid to flow in a fluid flow pattern including at least two of the loops.

The fluid may flow through a first additional flow line directing the fluid from a vessel of the kind as discussed above, to one of the main distribution devices or to one of the distribution devices and into the selected loop(s) by selecting a position of one of the main distribution devices or distribution devices. The flow of fluid may return to the vessel through the first additional flow line or another additional flow line by selecting a position of one of the main distribution device or distribution devices.

BRIEF DESCRIPTION OF THE DRAWINGS

An example of the invention will be described in the following with reference to the figs wherein.

DETAILED DESCRIPTION OF THE PREFERRED EMBODIMENTS

Figure 1A:
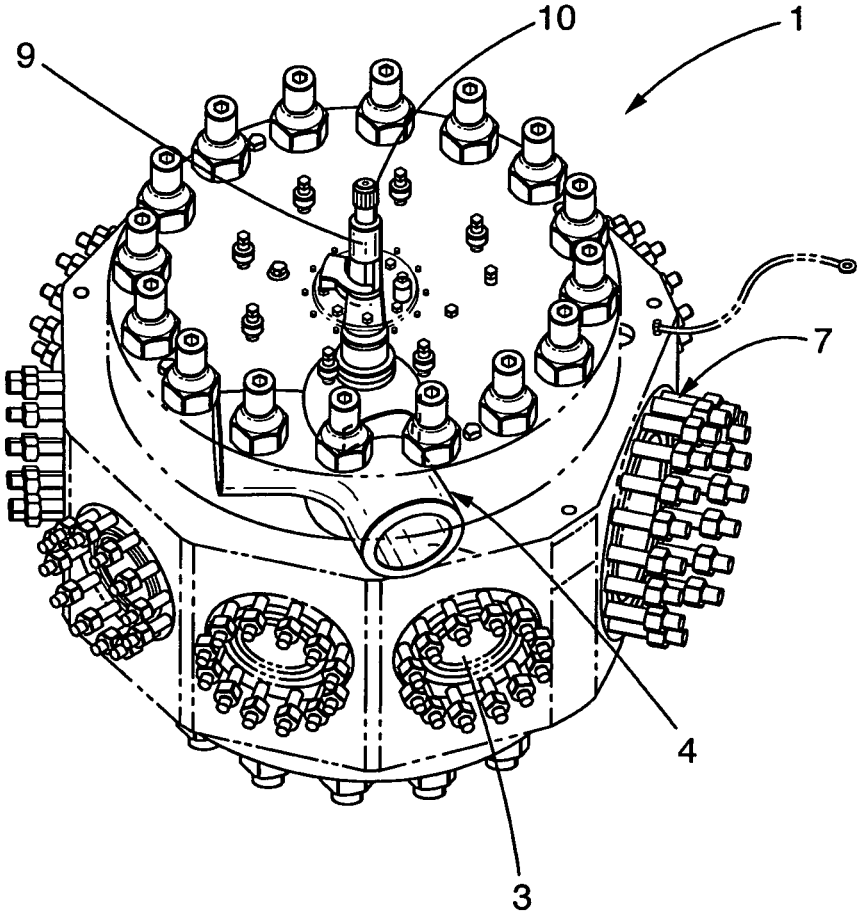
FIG. 1 is view of an example of a distribution device.
Figure 1B:
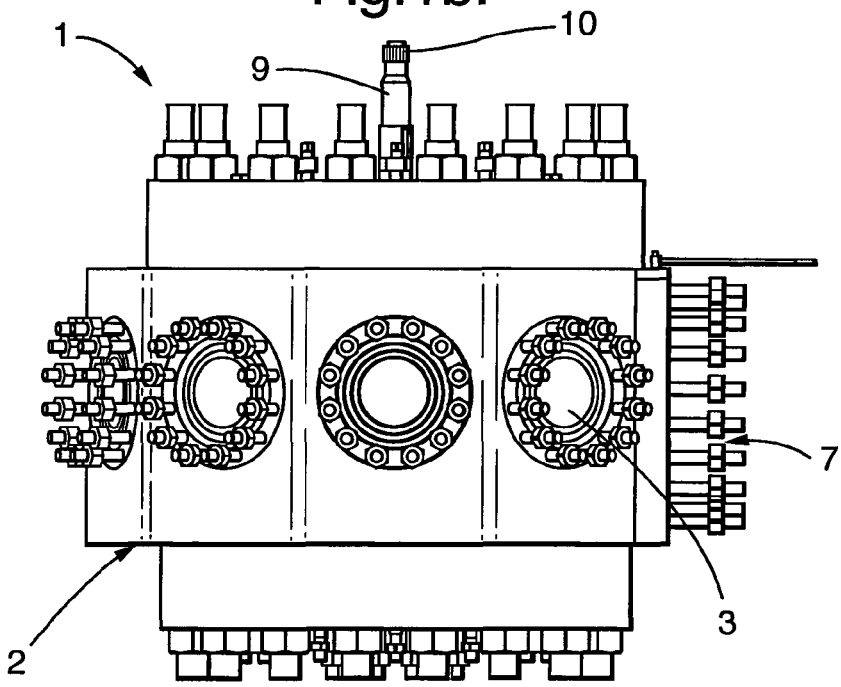
Figure 1C:
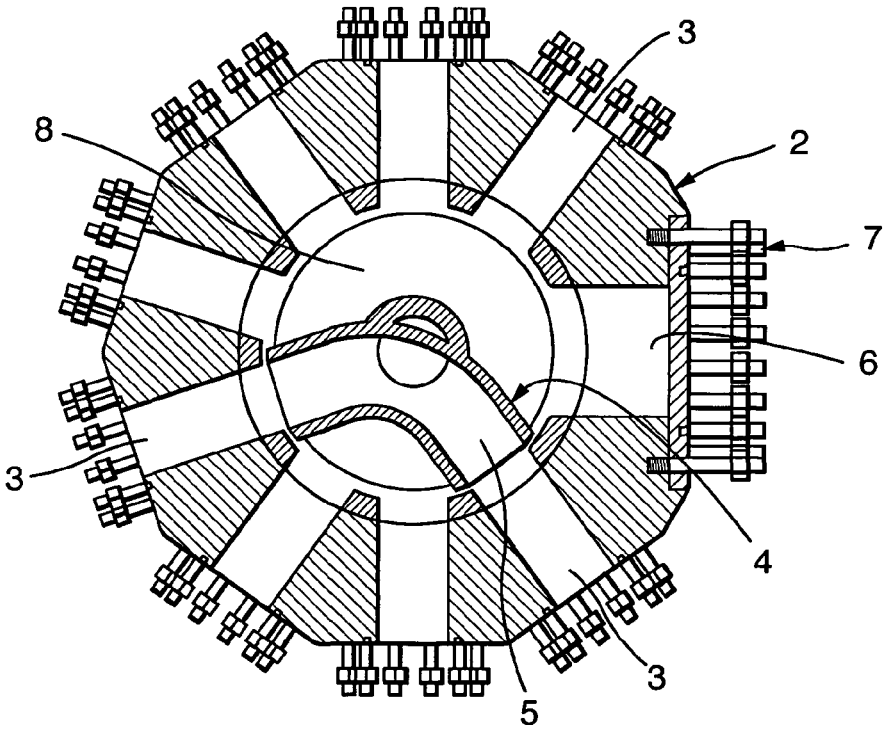

FIG. 1 shows various views of a distribution device 1 comprising a housing 2 provided with ports 3 for the passage of a fluid flow. A selector body 4 is provided with a through passage 5 for the fluid to flow through. The selector body 4 is movably arranged in an inner space 8 of the housing 2. In the embodiment shown in FIG. 1 a rotatable axle 9 is provided connecting the selector body 4 to the housing 2 to rotate the selector body 4 between various positions connecting two of the ports 3 of the housing 2. The operation of the selector body 4 to reposition it in the inner space 8 may be carried out by operating means connected to the end 10 of the rotatable axle 9. The selector body 4 may be prepared for rotation in one direction only, or may be arranged for rotation in both directions. In the latter case, the selector body 4 must be provided for stopping in a preselected position (or in several positions) no matter the direction of rotation. Hence, suitable stopping means may be provided accordingly.

In the shown embodiment the housing is arranged with eight ports 3 for fluid to flow through. As the skilled person will realize, the number of ports 3 and their location around the perimeter of the housing 2 will vary according to the application wherein the distribution device 1 is to be used. The selector body 4 is given a bended shape to connect ports 3 spaced at given interval around the perimeter of the housing 2. The shape of the selector body 4 and then subsequently the angle between the centre axis of the ports 3 to be fluidly connected by the through passage 5, may of course vary depending on the field of use. An access port 6 is arranged in the housing for providing access to the inner space 8 of the housing accommodating the selector body 4. If necessary to move the selector body 4 manually, in case of emergency or by failure of the means to operate the axis 9, the access port 4 is made available by removing closure 7. It would then be feasible to reach the selector body 4 by a suitable tool to change its position. Further, the access port is used when installation or maintenance of the selector body 4 is deemed necessary.

Figure 2A:
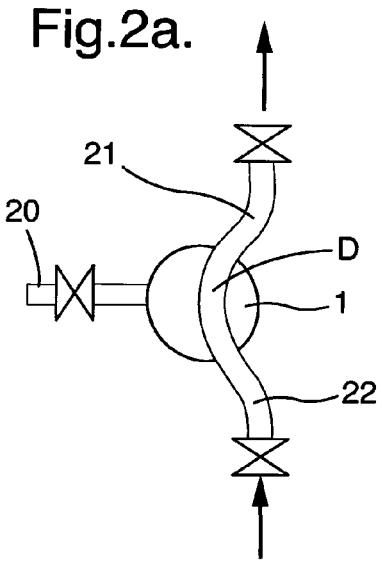
FIG. 2*a*-2*c* illustrates an example of use of the distribution device as shown in FIG. 1.
Figure 2B:
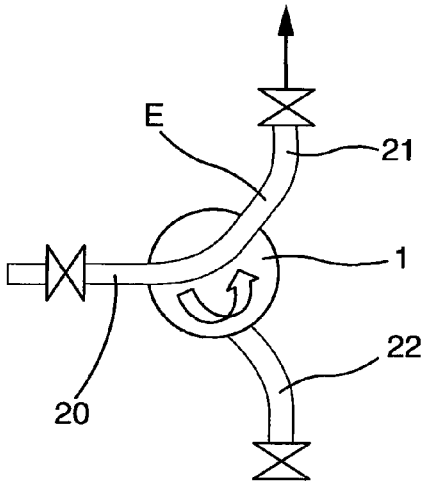
Figure 2C:
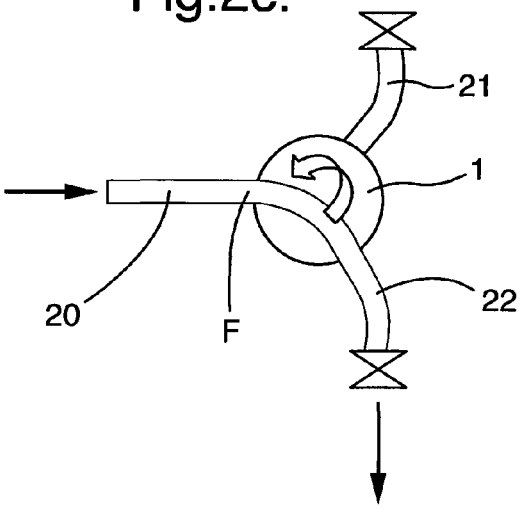

In FIG. 2*a*-2*c* an example of the use of the distribution device 1 in three different positions is shown. FIG. 2 shows three flow lines 20, 21, 22 which may be connected in various ways by the use of the distribution device 1. In these figs, the distribution device 1 is only schematically shown and the various positions of the distribution device 1 are illustrated by the flow through the distribution device 1, shown by arrows and lines D, E and F. In FIG. 2*a* the distribution device 1 is shown connecting the flow lines 21 and 22 by the selector body 4 being placed in a position for fluid to flow from flow line 21 to flow line 22 through the flow through passage 5 of the selector body 4, see line D. By rotating the selector body 4 into another position, the flow lines 20 and 21 are connected for fluid flow through the distribution device 1, closing off flow line 22, as shown in FIG. 2*b*, see line E. Further rotation of the selector body 4 into a further another position, connects the flow lines 20 and 22 for fluid communication between them through the distribution device 1 and closes off the flow line 21, see line F. By rotating the selector body 4 between the three positions as shown in FIGS. 2*a*-2*c*, three different flow patterns are obtained by selecting the positions of the shown distribution device 1.

Even though only three positions of the distribution device 1 are shown in FIGS. 2*a*-2*c*, the distribution device 1 as shown in FIG. 1, has a potential for assuming more than these three positions. The distribution device 1 as shown in FIG. 1 has eight ports 3 for the inlet and outlet of fluid flow and thereby the distribution device 1 is capable of obtaining plural number of positions by rotating the selector body 4 into the desired position for the interconnection of the flow lines transporting fluid.

Figure 3:
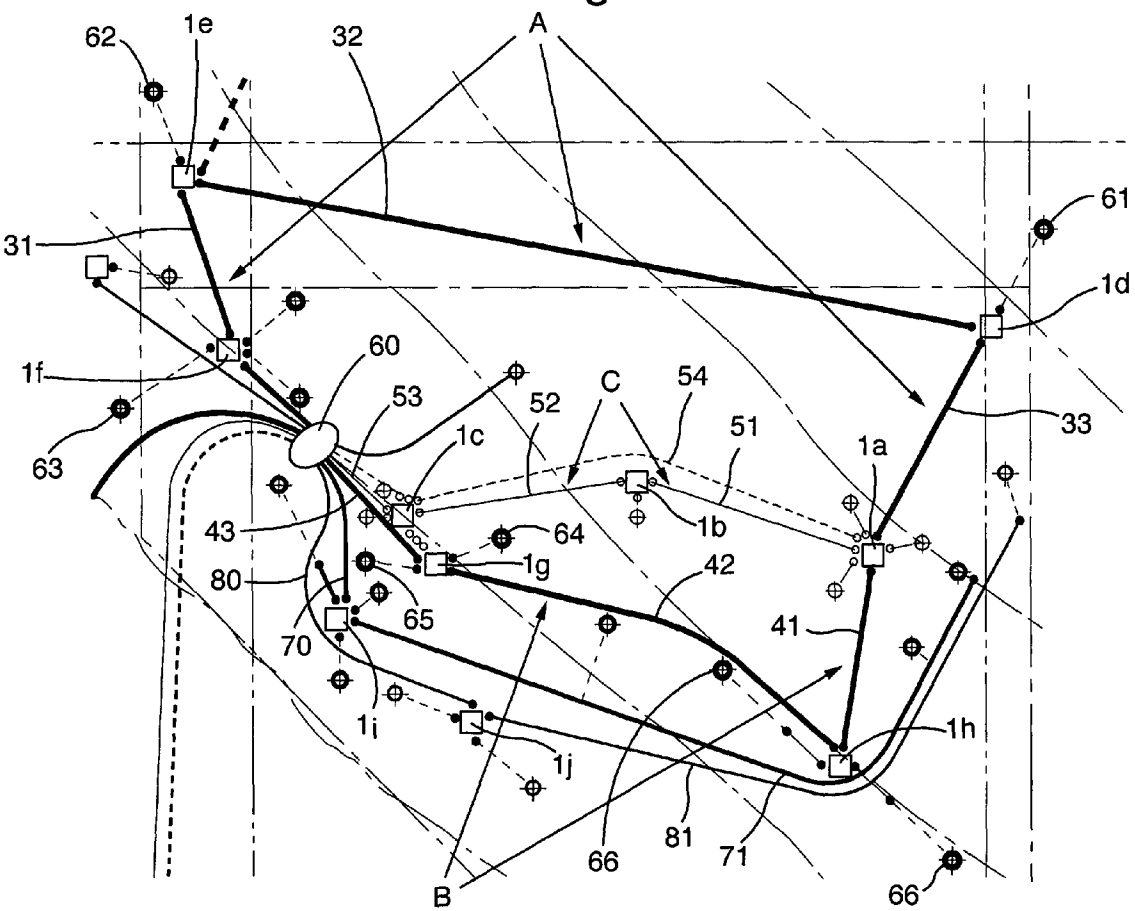
FIG. 3 is an illustration of an example of the arrangement of flow lines and distribution devices.

FIG. 3 shows an example of a schematic system of submerged flow lines connected by plural distribution devices as shown in FIGS. 1, 2*a*-2*c*. The flow lines 31, 32 and 33 comprise a first loop A and the flow lines 41, 42 and 43 comprise a second loop B. The ends of first and second loops are shown connected to main distributor devices 1*a* and 1*c*. The flow lines 51 and 52 make up a main flow line C having ends connected to the same main distributor devices 1*a* and 1*c*. By the use of the main distributor devices 1*a* and 1*c*, the main flow line C is connected to loop A in one position of each of the main distributor devices 1*a* and 1*c*, and in another position of each of the main distributor devices 1*a* and 1*c* main flow line C is connected to loop B. Further, altering the main distributor devices 1*a* and 1*c* into further another position provides for the connection of loop A and B. Each of the loops A, B and the main flow line C is provided by plural flow lines connected by distributor devices 1*b*, 1*d*, 1*e*, 1*g*, 1*h*. As the skilled person will realize, more than the shown two loops may be connected to the main flow line C, and also each of the loops may be connected to further loops or flow lines.

The flow lines in FIG. 3 are shown connected to a vessel 60, such as for instance a FPSO or other marine operating vessels suitable for the operation to be carried out. The flow lines (risers) 43, 53 and 54 provide connection between vessel and the system of flow lines as shown in FIG. 3, and the main distributor devices 1*a*, 1*c* and 1*i* are used to control the closing off or providing a connection between the vessel and the system of flow lines.

The fluid to be transported in the shown flow lines may be various kind of fluid, depending on the operation mode of the flow line in use. The fluid may be hydro carbons streaming from the wells 61-66 and into the flow lines, controlled by the associated distributor device or by some other kind of valve device. The hydro carbons is transported via the flow lines in the chosen flow pattern and to the vessel 60. In the cases where the flow lines need to be cleaned, the fluid may be methanol, in the case of providing corrosion prevention to the inside walls of the flow line, the fluid may comprise a inhibitor. There may also be a need for inspecting or removing debris from the inside of the flow lines and to perform this inspection a tool for instance a pig may be used. The tool may be transported in the flow lines by the pressure provided by the fluid flow or may be provided with a drive of some kind.

For the cleaning and or inspection of the flow lines, the tool and or the cleaning fluid may be sent from the vessel 60 via flow line 54, in this case functioning as a service line, to the main distributor device 1*a*, wherefrom the cleaning fluid and or tool may be directed into loop A or B. After circulation in the loops A, B the fluid/tool is returned to the vessel in flow lines 43 or 53.

The system as shown in FIG. 3 also includes flow lines 70, 71, 80, 81 not configured to form loops. The flow of fluid through these flow lines is also controlled by the distributor devices 1*i*, 1*j*.

The invention claimed is:

1. An arrangement for directing a fluid flow or a tool transported in a fluid flow in an underwater structure, comprising plural flow line arrangements each including plural flow lines, and at least two distribution devices, wherein each of the at least two distribution devices connects at least two of the flow lines wherein each of the at least two distribution devices comprises a housing arranged with plural ports for inlet and outlet of the fluid flow, and in the housing a selector body is movable between various positions to interconnect at least two of the flow lines to select a fluid flow pattern directing the fluid through the distribution device and the at least two flow lines, depending on a position of the selector body of the distribution device wherein the fluid flow pattern constitutes a loop.

2. The arrangement in accordance with claim 1, wherein the arrangement comprises a first flow line arrangement with a first distribution device and a second distribution device provided at each end of the first flow line arrangement, and at least an additional flow line arrangement having one end connected to the first distribution device and the other end connected to the second distribution device.

3. The arrangement in accordance with claim 1, wherein at least one additional flow line extending from a surface or subsurface vessel is connected to one of the distribution devices.

4. The arrangement in accordance with claim 1, wherein the selector body is provided to position a through passage of the selector body in a line with two of the ports for communication of the fluid flow through the distribution device.

5. The arrangement in accordance with claim 1, wherein the housing is provided with an access port.

6. The arrangement in accordance with claim 1, wherein at least one of the distribution devices or a valve is arranged for communication of fluid between the flow line arrangements and an underwater structure.

7. The arrangement in accordance with claim 6, wherein the underwater structure comprises a well.

8. The arrangement in accordance with claim 6, wherein the underwater structure comprises a subsea structure.

9. The arrangement in accordance with claim 1, wherein the distribution device is provided for stopping in at least one preselected position.

10. Method for directing a fluid flow or a tool transported in a fluid flow in an under water structure, comprising flowing the fluid in a flow line arrangement comprising a main flow line which is provided with at least two main distribution devices, and at least two loops wherein each loop comprises a configuration of a number of flow lines and distribution devices, wherein each loop is arranged with one end connected to one of the main distribution devices and the other end of each loop to another of the main distribution devices, wherein each of the distribution devices and the main distribution devices comprises a housing arranged with plural ports for inlet and outlet of fluid flow, and in the housing a selector body is movable between various positions to direct the fluid to flow in a certain flow pattern including at least two of the loops or the main flow line and at least one of the loops.

11. The method in accordance with claim 10, further comprising selecting a position of the selector body of one of the main distribution device directs the fluid to flow in a certain flow pattern in the selected loop, wherein selecting another position of the selector body of one of the main distribution device directs the fluid to flow in a fluid flow pattern including at least two of the loops.

12. The method in accordance with claim 10, wherein the fluid flows through a first additional flow line directing the fluid from a vessel (surface or subsurface) to one of the main distribution devices or distribution devices and into the selected loop(s) by selecting a position of the selector body of one of the main distribution devices or distribution devices.

13. The method in accordance with claim 10, further comprising directing the flow of fluid to return to the surface vessel through the first additional flow line or another additional flow line by selecting a position of the selector body of the main distribution device.

* * * * *